United States Patent [19]

Wright

[11] Patent Number: 4,565,137

[45] Date of Patent: Jan. 21, 1986

[54] BIO-MASS SUSPENSION BURNER

[75] Inventor: Richard C. Wright, Mequon, Wis.

[73] Assignee: Aqua-Chem, Inc., Milwaukee, Wis.

[21] Appl. No.: 689,459

[22] Filed: Jan. 7, 1985

Related U.S. Application Data

[63] Continuation of Ser. No. 521,255, Aug. 8, 1983, abandoned.

[51] Int. Cl.[4] ..... F23D 1/02

[52] U.S. Cl. ..... 110/264; 110/234; 110/265; 431/173

[58] Field of Search ..... 110/260, 261, 262, 263, 110/264, 265, 234; 431/10, 173, 182, 185, 187

[56] References Cited

U.S. PATENT DOCUMENTS

| | | | |
|---|---|---|---|
| 2,772,645 | 12/1956 | Hardgrove | 431/173 |
| 2,973,727 | 3/1961 | Northcote | 431/173 |
| 3,400,921 | 9/1968 | Hemker | 110/264 |
| 3,822,654 | 7/1974 | Ghelfi | 110/260 |
| 4,147,116 | 4/1979 | Graybill | 110/264 |
| 4,253,403 | 3/1981 | Vatsky | 110/263 |
| 4,333,405 | 6/1982 | Michelfelder et al. | 110/265 |
| 4,407,205 | 10/1983 | Beaufrere | 110/264 |
| 4,422,389 | 12/1983 | Schroder | 110/264 |
| 4,428,309 | 1/1984 | Chang | 110/262 |

*Primary Examiner*—Albert J. Makay
*Assistant Examiner*—Steven E. Warner

[57] ABSTRACT

A bio-mass suspension burner for use with furnaces or boilers includes a delivery system for injecting particulate solid fuel into a combustor. A primary air stream mixes with and conducts the fuel into the combustor. Secondary air is introduced at the point of ignition, while tertiary air is introduced tangentially to maintain a cyclonic vortex. The burning, gasified fuel exits the combustor through a nozzle where quartiary air is introduced to burn the gas. Proper flame stability, gasification and ash fusion control is achieved by regulation of the various air streams.

8 Claims, 4 Drawing Figures

BIO-MASS SUSPENSION BURNER

This is a continuation of application Ser. No. 521,255, filed Aug. 8, 1983, now abandoned.

BACKGROUND OF THE INVENTION

1. Field of the Invention

The present invention relates generally to the art of fuel burners and more particularly to the art of burners for solid particulate fuel.

2. Description of the Prior Art

The prior art contains numerous examples of burners designed to burn a wide variety of liquid, gaseous and solid fuel materials. Since the present invention relates primarily to the combustion of bio-mass fuels, the description of the prior art will be addressed primarily to combustors for bio-mass fuels. Furthermore, for reasons which will soon become apparent, the description will be more specifically addressed to wood combustors.

For many years, researchers have been working on devices for efficiently burning bio-mass materials. The reasons are quite obvious, especially in these times of rising fuel prices and energy shortages. Wood is a renewable resource and is readily available in most geographic areas. Furthermore, scrap wood is available for energy use. Other bio-mass materials are also available in commercially significant quantities.

While the combustion of bio-mass materials has been known since the early days of mankind, the burning of wood in a controlled manner has received less attention from the scientific community than has been the case with the burning of other fuels such as gas, oil or coal. In reality, the burning of wood remains somewhat of an art as opposed to a developed science. To understand the reason for the failures of past inventive efforts, it is necessary to understand the factors which influence the efficient combustion of such solid fuels.

Two primary factors are particle size and moisture content. Particle size is important because small particles expose more total surface than larger particles and the burning rate depends on exposed surface area. Particle volume or mass increases as the cube of its diameter, while surface area increases only as the square of the diameter. Burning time is, therefore, directly proportional to particle size. Moisture is important because the wetter the wood, the more difficult it is to burn. These basics then dictate that a large number of small particles of dry wood be used in any efficient wood burning system.

Another primary factor relates to the controls necessary to regulate the combustion process, i.e., controls affecting combustion efficiency, emissions, ash condition, etc. Other related factors include the reactivity of the fuel with the oxidizer, burning temperature, residence time in the combustion zone, and the intimacy of mixing of the fuel and oxidizer.

Several types of suspension firing systems are known for use with wood and other solid materials. Suspension systems are those in which the fuel is supported by air and the burning gases, and there is no bed of fuel supported by a grate, hearth or retort. Burning particles are suspended in the flame until consumed or extinguished. Laminar or axial flow flame burners are known, and these typically include a system for injecting combustion air and fuel in parallel streams. Laminar or axial flow burners are commonly used in large boilers, usually with several individual burners firing in a common furnace. Such burners require a comparatively large furnace and the quality of combustion depends upon the manner in which the burners are arranged.

Furnaces fired by a single suspension burner generally use some form of cyclonic or vortex combustion system where fuel is injected tangentially into a cylindrical or conical combustor and the burning particulate material revolves about the axis of the flame. Cyclonic furnaces provide long flow paths for the burning of fuel, thus creating longer residence time within a smaller combustion zone. Boilers having small combustion chambers are generally limited to liquid and gas fuel firing, and if wood is the chosen fuel, the combustion system must be very efficient.

Cyclonic combustors may be either of two basic types, i.e., single vortex or double vortex. In single vortex systems, the fuel enters one end of the combustor and hot products of combustion exit the other. In a double vortex combustor, some or all of the fuel is injected tangentially near the end from which the flame exits. Burning progresses in two concentric rotating streams. While the present invention is not to be limited to any particular type of vortex, and in fact can be used with double vortex combustors, reference will be had here and in the remaining description to a single vortex type.

The system of the present invention is most suitable for use with dry fuels as pointed out above. Commonly, in wood burning, "dry" refers to wood having a moisture content of less than 12%. Moreover, it is desirable to have a highly reactive fuel, i.e., wood or wood char having a relatively high oxygen content. Oxygen contents between 35–45% are most advantageous. It is also important in burning wood to have a relatively low ash content, for example, less than 6% and a relatively high ash fusion temperature, for example, over about 2200° F. The combination of fuel properties mentioned above may vary, and none of these factors is deemed to be limiting as to the scope of the invention.

It is also known that the combustion air may be introduced in a variety of ways and, in some instances, in multiple stages for minimizing the generation of nitrogen oxides. For example, one system for burning wood is disclosed in U.S. Pat. No. 3,856,455 issued on Dec. 24, 1974 to Otway et al. for "Method and Apparatus For Mixing and Turbulating Particulate Fuel With Air For Subsequent Combustion." In this patent, particulate fuel is mixed with a relatively small quantity of air and supplied into one end of a chamber so as to promote turbulence in the mixture as it passes along the chamber to an outlet. Ignition takes place at the outlet and further air is added to the mixture in the region of the outlet to permit full combustion of the entrained fuel when discharged therefrom. The turbulation is maximized in that the air and fuel inlets are positioned to provide a cyclonic movement. Suitable guides may be provided within the chamber to cause further turbulent effect. This patent then provides for the introduction of primary and secondary air and indicates that the amount of air should be selected so that the primary and secondary air, when combined, provide sufficient air to support combustion of the suspended fuel.

Another device for burning wood fuel is disclosed in U.S. Pat. No. 4,249,471 issued on Feb. 10, 1981 to Gunnerman and entitled "Method and Apparatus For Burning Pelletized Organic Fiberous Fuel." In this patent, a pellet of solid fuel is mixed with a flammable gas or liquid and burned in a combustor. The combustor contains an overfire system which is designed for efficient combustion and the production of a minimum number of solid combustible products as ash. The flammable gas mixed with the solid fuel material may be made by burning pellets of an organic fiberous material. The wood particles are injected into the flammable gas and, together with air, and are introduced tangentially to provide a cyclonic movement of the solid particles about the burning flammable gas stream which passes axially through the combustor inlet. A diffuser is also provided to insure proper combustion of the particles and gas as they progress through a confinement cylinder.

While introduction of combustion air in multiple stages is recognized, the amount of air introduced and the location of air introduction has still not been optimized in theory or practice.

OBJECTS AND SUMMARY OF THE INVENTION

It is a primary objective of the present invention to provide a system for burning particulate bio-mass efficiently, i.e., with a reduced volume of ash and undesirable emission products.

Another object of the present invention is to provide a system generating high density granular ash material which may be easily separated by gravity from the gaseous products of combustion.

Yet another object of the present invention is to provide controlled release of heat and efficient combustion from a bio-mass burner.

Still a further object of the present invention is to reduce the amount of excess air required for complete combustion.

A different object of the present invention is to provide an increased rate of heat transfer from the flame produced by the burning system of the present invention by increasing the luminosity and emissivity of the flame.

Yet another object of the present invention is to employ the hot ash particles generated in the system as heat carriers and to minimize slag formation by controlling gasification temperature below the ash fusion temperature.

Another object of the present invention is to provide a reliable and safe solid fuel suspension burner which is compact in structure and which can be economically manufactured.

Another object of the present invention is to provide a system which is readily adaptable to numerous types of boilers and furnaces and which may be automatically regulated to reduce the amount of attendant labor.

A still further object of the invention is to provide a system which may be used with oil or gas fuels or any combination of such fuels, with or without wood, in the event wood or other bio-mass material is not present in sufficient quantity.

How these and other objects of the present invention are accomplished will be described in the following specification taken in conjunction with the drawings. In general, the invention relates to a combustor in which a fixed flow rate of primary air mixes with and conducts fuel into a first stage combustor. The metered fuel should be dried and comminuted if required. A variable flow rate secondary air stream is introduced at the point of ignition to create a stable flame front with rapid and easy ignition. Tertiary air is introduced tangentially from the combustor wall to maintain a cyclonic vortex, holding the burning particles within the combustor by centrifugal force until completely gasified at a temperature below the ash fusion point. Finally, the burning and gasified combustible mixture exits the combustor through a high temperature nozzle where a fourth air stream is introduced. Preheated quartiary air burns the gas generated in the combustor at a temperature above the fusion temperature of the ash. Means are provided for regulating the quantity of the secondary, tertiary and quartiary air flow rates. The combustor typically has a cylindrical refractory wall and a high temperature refractory flame nozzle is provided. Means for igniting the fuel and for sensing the presence of a flame may also be provided. The primary novelty of the present invention is the staged arrangement of combustion air injectors and the use of fourth stage air injected directly into the flame in such a manner as to produce intimate mixing of heated air and burning gas.

DESCRIPTION OF THE PREFERRED EMBODIMENT

Figure 1:
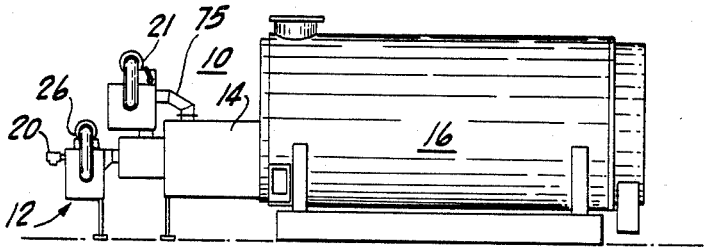
FIG. 1 is a perspective view of a suspension burner and firetube boiler assembly, the bio-mass burner of the present invention being shown in general form.

FIG. 1 shows in generally schematic form a burner and boiler assembly 10 which includes an air and fuel delivery system 12, a combustor 14 and a boiler 16. The present invention relates primarily to the combustor system 14, so the air and fuel system 12 and the boiler 16 will be described only in general terms. This is especially true with respect to the boiler 16. While the illustration shows the combustor 14 used with a firetube boiler, it must be clearly understood at the outset that the suspension burner of the present invention may be used with a wide variety of other types of boilers (such as watertube) or with furnaces of many different designs.

With respect to the fuel delivery system 12, it will be noted that the drawings show means to couple alternate fuels, i.e., oil and natural gas, to the combustor 14 and it should be mentioned here that the apparatus of the present invention will primarily be used with one fuel at a time. When bio-mass is unavailable or in short supply, gas can be injected into combustor 14 through an inlet 19 or oil can be injected through oil inlet 20. Further details of the system for introducing the alternate fuels will become apparent from the more detailed FIG. 3.

Figure 2:
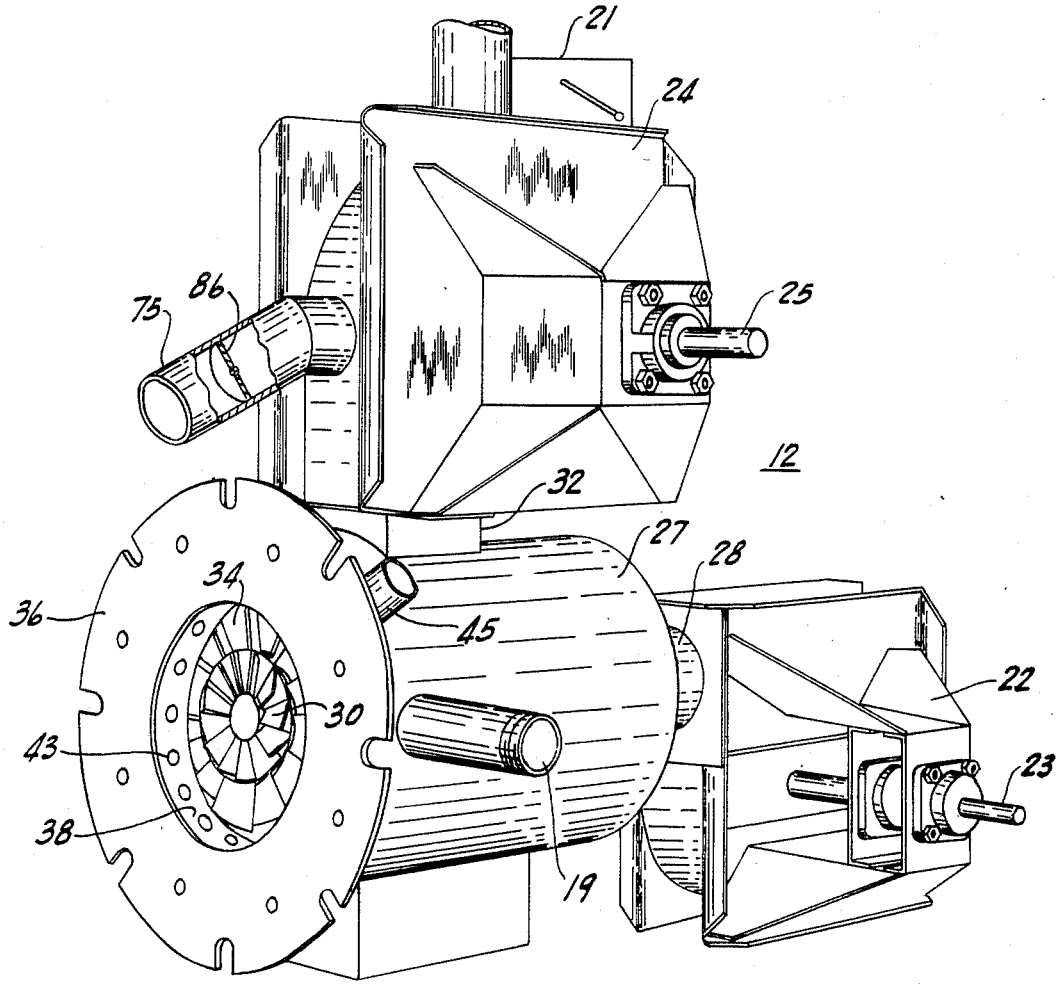
FIG. 2 is a more detailed perspective view of the air and fuel delivery systems of the bio-mass burner of the preferred embodiment of the present invention.
Figure 3:
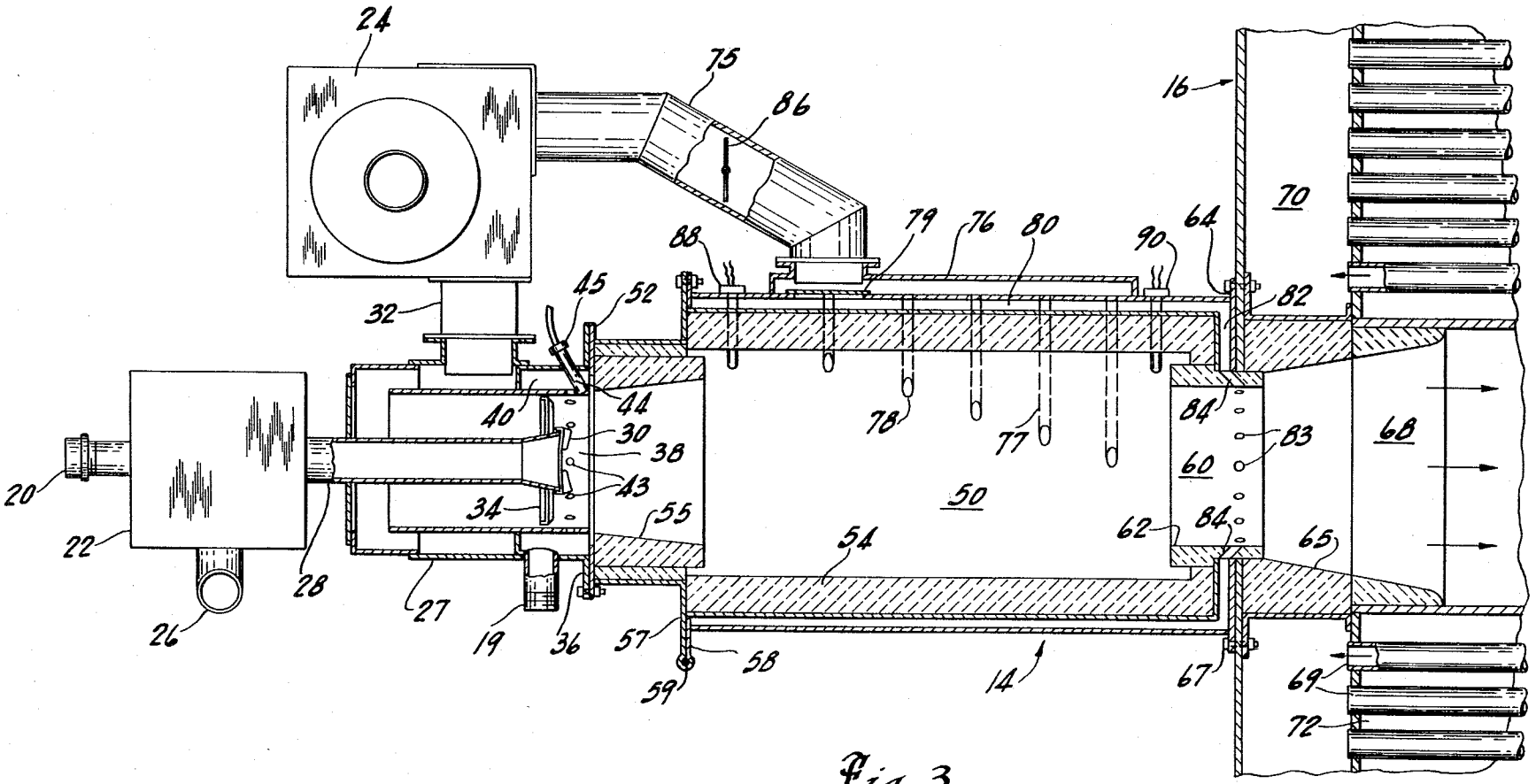
FIG. 3 is a longitudinal section through the combustor of the assembly of FIG. 1 showing the internal details of the burner according to the preferred embodiment of the present invention and also showing a portion of the internal components of the boiler for purposes of illustrating the present invention.

The air and fuel delivery system 12 is shown in greater detail in FIG. 2 to include a first primary air fan 22 having a drive shaft 23 and a second air fan 24 driven by shaft 25. It will be appreciated by those skilled in the art that the fans may be regulated by suitable drive controls (not shown) and that motors (not shown) will be provided as the power sources for the two fans. Not shown in this drawing, but shown in FIG. 3, is a duct 26 for feeding particularized bio-mass material into primary fan 22 so that the particles are entrained in the primary air stream. The amount of air admitted to fan 24 is controlled by any suitable air volume regulator, such as the damper regulator shown at 21 in FIG. 1. As is also apparent from FIG. 1, if oil is used as the fuel source, it is injected with the primary air by fan 22.

A burner housing 27 is coupled to fans 22 and 24. Housing 27 is generally cylindrical in configuration. Fan 22 is coupled thereto in a generally axial direction through fan outlet duct 28 which passes longitudinally through housing 27 and terminates at a fuel and air diffuser 30 of conventional design, diffuser 30 being adapted to impart a swirl to the fuel and primary air as it exits the burner housing 27. Fan 24 is coupled to housing 27 in this embodiment through a second fan exit duct 32 which passes radially through the wall of housing 27. Air introduced through duct 32 leaves the housing through a second swirl inducing air diffuser 34 located in generally surrounding relationship to diffuser 30. It will be noticed from FIG. 2 that the vanes of the respective air diffusers are oriented to cause the secondary air and primary air and fuel flows to swirl in the same direction.

The air diffusers 30 and 34 terminates inwardly of the burner mounting plate 36 and the space 38 between plate 36 and the forward end of the diffuser 30 provides a convenient location for the introduction of natural gas, as an alternate fuel. Inlet 19 is shown in FIG. 2 and it will be appreciated that it enters a generally annular chamber 40 surrounding space 38. Gas is introduced into space 38 through the plurality of holes 43 located in this area.

It will also be appreciated from FIG. 2 that an ignitor 44 is provided in space 38 through an ignition mount 45. This device may be of any conventional design and will not be described in any detail.

The above and further features of the present invention will become apparent from an examination of FIG. 3 where the components described above are shown together with the details of the combustor system 14. Plate 36 of housing 27 is coupled to a first end of a generally cylindrical combustor housing 50 through a matching plate 52 on the left end thereof. Combustor housing 50 may be made of metal and includes a refractory lining 54 along its entire length. Further, it will be appreciated from this drawing that an inlet cone 55 of refracting is formed at the left end of combustor housing 50 and includes a gradually diverging area for the fuel and air entering combustor housing 50. Cone 55 and the remainder of combustor housing 50 may be prepared as a unitary structure or in two sections, the latter being shown in the FIGURE. The two sections of housing 50 are coupled by the mounting plates 57–58 and a hinge 59 may be provided for service or maintenance access.

The right end of combustor housing 50 includes a slightly restricted outlet 60 surrounded by a ring 62 of refractory. A mounting plate 64 is provided at the right end of combustor housing 50, the refractory ring 62 extending therethrough by a short distance. The protruding refractory extends into and is received by the refractory 65 of the boiler 16.

Only a few of the boiler components will be described in connection with this FIGURE. A combustion area 68 for hot gas is located at the boiler entrance and tubes 69 are provided for the flow of heated gas through the boiler to the boiler's gas outlet 70 in the direction shown by the arrows. Water is located intermediate the firetubes 69 in spaces 72 to be heated by heat transfer and produce steam or hot water as is well known to the art.

Returning once again to the combustor housing 50, FIG. 3 also illustrates the tertiary and quartiary air introduction systems. Both receive an air flow from fan 24 which is coupled to the combustor 50 through a duct 75. Duct 75 terminates in a header 76. The header 76 directly feeds a plurality of passages 77 located in the refractory of the combustor with exit holes 78 arranged as illustrated for inducing further cyclonic vortex movement within and along the wall of combustor housing 50. The air is injected tangentially to hold burning particles within the combustor until completely gasified at a temperature below the ash fusion pont. The particular air hole pattern is not critical to the invention and the number of holes may be widely varied to accomplish the above mentioned objectives. The amount of air admitted into passages 77 will depend on the orientation of a sliding damper plate 79 which is used to adjust the relative quantities of tertiary or quartiary air flow.

When damper 79 is open header 76 also feeds an annular chamber 80 which surrounds the combustor housing 50 and is closed at its left end by coupling plate 58. At the right end of combustor housing 50, chamber 80 bends inwardly at 82 to surround ring 62. A plurality of holes 83 are provided in ring 62 with slanted passages 84 coupling holes 83 and area 82 of the chamber. Holes 83 are for the introduction of the fourth air stream. The slanted nature of the passages 84 results in the fourth air stream being injected outwardly from ring 62. Such air stream is preheated by its passage along the periphery of combustor housing 50 and its passage through area 82 and the refractory ring 62. This preheated quartiary air burns the gas generated in the combustor at a temperature which is above the fusion temperature of the ash. Heat, which otherwise would be released in the combustor, is released after the flame enters the boiler. The resulting flame transmits more energy by radiation directly to boiler primary heat absorbing surfaces. Combustor temperature is lower than when all combustion air is injected within the combustor. Thermocouples 88 and 90 are illustrated in FIG. 3 and are employed for measuring the temperatures at the entrance and exit of housing 50.

Control of the introduction of secondary, tertiary and quartiary air is an important factor of the present invention and may be accomplished in any conventional manner, such as by varying fan speeds, damper systems, etc. The proportionate flow may also be varied by changing the size of the various headers, entry holes and the like. In FIGS. 2 and 3 a damper 86 is provided in duct 75 to control the relative amounts of air leaving fan 24 through ducts 32 and 75.

In operation, the suspension burner of the present invention is used with a storage means (not shown) for the bio-mass fuel. That storage means may be employed with a fuel dryer means, if required, together with a fuel metering means and a fuel comminuting means, if required. These devices are not shown in detail in the FIGURES, as they may be of any conventional design and, in and of themselves, form no part of the present invention.

The small dry particles of solid fuel are introduced, along with the primary air by fan 22. They pass through duct 28 and are introduced into combustor 14 through fuel diffuser 30. The diffuser 30 creates a swirl effect as the fuel exits the duct 28. A surrounding air flow of secondary air is introduced from fan 24, through duct 32 and through a secondary diffuser which serves to create a stable flame front with rapid and easy ignition by ignitor 44. The burning fuel particles and surrounding secondary air are introduced into the combustor 14 where the swirl and cyclonic vortex effect are continued by the tertiary air and finally, the particles pass through the nozzle inlet under the influence of the quartiary air.

The quad air system of the present invention has many advantages, e.g., complete combustion, controlled ash fusion and high radiant heat transfer to the boiler heating surfaces. Heat transfer by radiation varies as the fourth power of absolute temperature and heat transfer is therefore greatly increased by high flame temperature. But, flame temperature alone is not the only source of effectiveness of the flame. Emissivity is another important factor. Emissivity from a luminous flame is greater than from a non-luminous flame, so the presence of ash particles in the flame greatly increases luminosity and emissivity. This is evidenced by a white hot flame.

Ash particles in the flame have another beneficial effect as heat carriers. Specific heat of ash is much higher than the specific heat of combustion gases. Ash particles in the flame have a catalytic effect, favorable to combustion.

Slag formation is minimized by controlling gasification temperatures below the ash fusion temperature. Final combustion is optimized by high flame temperature above the ash fusion temperature and these two temperature regulated combustion zones are very important features of the present invention.

It is also known that the chemical reaction velocity increases rapidly with temperature. For example, at about 2000° F., oxidation rate doubles with a temperature increase of 180° F. The combustion temperature of a wood burning firebox must not exceed the temperature at which ash meets and forms slag. Where ash is in suspension, the combustion temperature can be well above the melting temperature. This makes it possible to operate the solid phase zone at very high temperatures.

Another desirable result obtained by the system of the present invention is a dramatic reduction in the amount of excess air required for complete combustion. In actual practice, near stoichiometric combustion has been achieved with excess air limited to 5–10%. This compares with the 50–100% excess required by many combustion systems. Draft losses are reduced and boiler efficiency is increased because less thermal heat is lost to stack gases. Boiler capacity is also improved and efficiency increased through more efficient heat transfer. So while many boiler retrofits from gas or oil to solid fuels result in a decrease in boiler capacity by up to 20%, retrofits using the system of the present invention have made possible equal or even increased boiler efficiency and capacity.

Figure 4:
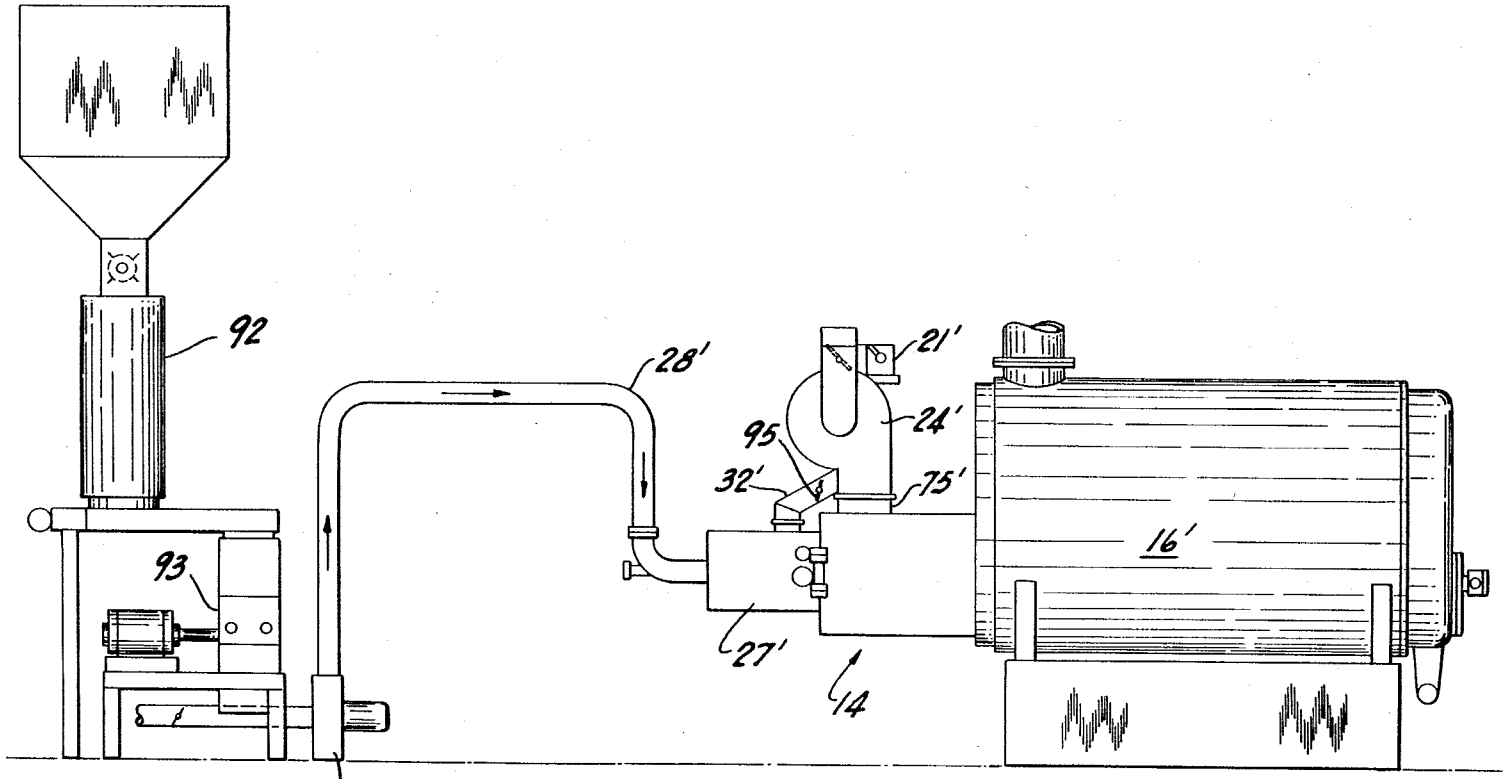
FIG. 4 is a perspective view of a suspension burner and firetube boiler assembly according to an alternate form of the invention.

An alternate form of the present invention is shown in FIG. 4, where like reference numerals with prime notations are used for like components shown in the earlier drawings. Two main alternate features are illustrated here, i.e., the location of the primary fan 22 and the coupling of fan 24. In FIG. 4, the primary fan 22 is located remotely from the burner housing and duct 28 is elongated. This arrangement may facilitate location of the fuel storage and fuel mill components shown generally at 92 and 93 respectively in existing installations.

The second feature shown in FIG. 4 is the coupling of fan 24' to combustor housing 50' rather than to burner housing 27'. This may be desirable because of weight considerations or for other installation reasons. Moreover, the degree of flexibility of the present invention is further illustrated in that a damper 95 is provided in duct 32' to regulate the relative flow of secondary air through this duct. This contrasts with the location of a damper 86 in duct 75 in the first embodiment. It should further be mentioned that in this embodiment regulation of tertiary and quartiary air is accomplished solely by selection of orifice size and that the sliding damper plate 79 used in the other illustrated embodiment has been eliminated.

While the present invention has been described by reference to two particular embodiments, the invention is not to be limited thereby, but is to be limited solely by the claims which follow.

I claim:

1. A burner for a combination mixture of particles of solid bio-mass fuel and air comprising:

means for providing a primary air stream;

means for entraining said solid fuel particles in said primary air stream;

a generally cylindrical, elongate combustor means having a first end and a second end;

means for injecting said primary air stream and entrained fuel particles through said first end of said elongate combustor means, said combustor means having an exit at the second end thereof;

means for providing a secondary air stream and means for injecting said secondary air stream through said first end of said combustor means in surrounding relation to said primary air stream and entrained solid fuel particles; said injecting means for said primary and said secondary air streams including diffuser means to impart a swirl to the air and solid fuel particles entering said combustor means;

means for providing a tertiary air stream and means for injecting said tertiary air stream into said combustor means at a plurality of locations along the length thereof; and means for providing a quartiary air stream and means at the exit of said combustor means for injecting said quartiary air stream outwardly of said combustor means and into the combustion mixture leaving said combustor means through said exit.

2. The invention set forth in claim 1 wherein said injecting means for said tertiary air stream includes means for injecting said tertiary air stream tangentially into said combustor means.

3. The invention set forth in claim 1 wherein said quartiary air stream injection means includes means for preheating said quartiary air stream.

4. The invention set forth in claim 1 wherein said means for providing said primary, secondary, tertiary and quartiary air streams comprise fan means.

5. The invention set forth in claim 4 wherein one fan means is provided for said primary air stream and a second fan means is provided for providing said secondary, tertiary and quartiary air streams.

6. The invention set forth in claim 5 wherein means are provided for controlling the amount of air from said second fan leading to said secondary, tertiary and quartiary air streams.

7. The invention set forth in claim 6 wherein said control means include damper means.

8. A method of burning a combination mixture of solid particulate bio-mass fuel and air comprising the steps of:

providing a generally cylindrical elongate combustion chamber;

introducing a primary air stream through a first end of said chamber and imparting a swirl thereto, said primary air stream having entrained therein solid particulate fuel;

introducing through said first end of said combustion chamber a secondary air stream in surrounding relationship to said primary air stream and imparting a swirl to said secondary air stream;

introducing a tertiary air stream at a plurality of locations along the length of said chamber;

introucing a preheated quartiary air stream at the second end of said combustion chamber into the combustion mixture leaving said chamber, said quartiary air stream being directed outwardly of said chamber; and the total amount of air being introduced by said primary, secondary, tertiary and quartiary air streams being only slightly in excess of that amount of air required for complete combustion of said particulate fuel, the amount of said primary, secondary and tertiary air being less than the stoichiometric amount of air required for such complete combustion within said combustion chamber and wherein combustion is completed outwardly of said combustion chamber by the introduction of said quartiary air stream.

* * * * *